US005479670A

United States Patent [19]

Coffey

[11] Patent Number: 5,479,670

[45] Date of Patent: Jan. 2, 1996

[54] DOUBLE-ENDED SOCKET WRENCH FOR SPRINKLER NOZZLES

[76] Inventor: William G. Coffey, 1347 N. 1350 East, Richfield, Id. 83349

[21] Appl. No.: 219,948

[22] Filed: Mar. 30, 1994

[51] Int. Cl.[6] ..... B25B 13/00

[52] U.S. Cl. ..... 7/138; 81/124.3; 81/177.7

[58] Field of Search ..... 7/138, 170, 169; 81/125.1, 124.3, 124.4, 124.7, 177.5, 177.7

[56] References Cited

U.S. PATENT DOCUMENTS

| | | | |
|---|---|---|---|
| 2,571,570 | 10/1951 | Hagar | 81/177.5 |
| 3,635,654 | 1/1972 | McFarland . | |
| 3,680,159 | 8/1972 | Wharram | 7/138 |
| 3,731,559 | 5/1973 | Krupke . | |
| 3,972,253 | 8/1976 | Rockwell et al. . | |
| 4,607,406 | 8/1986 | Davis, Jr. | 81/177.7 |
| 4,774,736 | 10/1988 | Brawner et al. | 7/138 |
| 5,050,464 | 9/1991 | Hurtig . | |
| 5,074,171 | 12/1991 | Annis et al. . | |

FOREIGN PATENT DOCUMENTS

| | | | |
|---|---|---|---|
| 349949 | 7/1905 | France | 81/177.7 |

*Primary Examiner*—Bruce M. Kisliuk
*Assistant Examiner*—Joni B. Danganan
*Attorney, Agent, or Firm*—Thorpe North & Western

[57] ABSTRACT

A double-ended socket wrench is disclosed for attaching and removing sprinkler nozzles from sprinkler heads. The double-ended socket wrench includes a housing with open first and second ends and an elongate chamber extending between the ends to allow water to pass in one end of the housing and out the opposing end of the housing. At least one of the open ends forms a socket disposed so that the socket can nest with a sprinkler nozzle while water is passing through the nozzle without significantly interfering with the flow of the water. In accordance with one aspect of the invention, an adjustable lever is attached to the housing to provide leverage while rotating the housing about its longitudinal axis.

8 Claims, 4 Drawing Sheets

DOUBLE-ENDED SOCKET WRENCH FOR SPRINKLER NOZZLES

BACKGROUND OF THE INVENTION

The present invention relates to a wrench for removing sprinkler nozzles, and in particular, to a wrench for removing and replacing sprinkler nozzles while the sprinkler is running so that the sprinkler may be cleaned or otherwise adjusted without stopping flow through a sprinkler system.

Due to weather patterns, many areas do not receive sufficient rainfall to provide all of the water needed by crops. To increase the amount of cultivatable land, irrigation has been used to supply the needed water. It is common in many agricultural areas to pump irrigation water through sprinkler systems which disperse the water over a large area. The sprinklers allow the water to be distributed relatively evenly over an area planted with crops needing water.

One problem which has developed with sprinklers is that they have a tendency to become clogged due to dirt and other sediments which are carried in the irrigation water. Over a period of time, sediments can collect and build to a point at which the sprinkler is no longer able to operate effectively. A pick or some other device capable of loosening the sediment blockage must be inserted into the sprinkler head to restore water flow. In some cases, the clog is adjacent to the sprinkler nozzle and can be broken up by inserting a pick through the nozzle. Occasionally, however, it is best to remove the sprinkler nozzle, thereby providing access to the inner flow path of the sprinkler. This may be due to the fact that the obstruction in the nozzle is so large that it cannot pass through—requiring the removal of the sprinkler nozzle. In the alternative, the clog may be sufficiently deep within the sprinkler head that it cannot be reached while the nozzle is in place.

While it is relatively easy to remove the sprinkler nozzle when no water is being passed through the system, it is difficult to tell whether or not a sprinkler is clogged unless water is being forced through the system. Thus, it is often beneficial to have water flowing through a sprinkler system to determine which are clogged and to determine when the sediment has been loosened sufficiently to restore proper water flow.

When water is being forced through the sprinkler under pressure, the sprinkler nozzle is relatively difficult to remove safely and efficiently. Also, the water escaping through the threads of the nozzle can interfere with seeing the sprinkler nozzle.

Another problem with removing sprinkler nozzles in a conventional manner is that as soon as the threads of the sprinkler nozzle are disengaged from the threads of the sprinkler head, the pressurized water can force the nozzle out of the control of the person removing the nozzle, i.e., the water causes the nozzle to be "squirted away". A person standing close to the sprinkler head may be hit by the nozzle and injured. More likely, however, the sprinkler nozzle will be lost as it falls to the ground.

Replacement of the sprinkler nozzle is difficult because, as the water continues to flow, the water interferes with the ability to properly seat the threads of the sprinkler nozzle in the threads of the sprinkler head. Additionally, until the nozzle becomes tight, water flows out between the threads of the nozzle and the sprinkler head, again possibly soaking the person replacing the nozzle.

In addition to being removed to provide access into the sprinkler head, sprinkler nozzles are also occasionally changed to allow different amounts of water to pass through the sprinkler. As a sprinkler system is moved from place to place, the amount of water to be passed through the system may change. Such a situation would exist, for example, when a farmer moves a sprinkler system from a field containing one crop to an adjacent field containing another. Rather than changing each sprinkler nozzle before pumping water through the system, it would generally be more convenient to change the nozzles as the sprinklers are working.

The present invention provides a convenient and economical solution to the above identified problems.

SUMMARY OF THE INVENTION

It is an object of the invention to provide an apparatus for removing and replacing sprinkler nozzles, while water is passing through the sprinkler head.

It is another object of the invention to provide a wrench for removing sprinkler nozzles with minimal disruption to water flow through the sprinkler head.

It is an additional object of the invention, in accordance with one aspect thereof, to provide a wrench having a cleaning tool capable of removing aggregated sediment within the sprinkler head.

The above and other objects of the invention are achieved by a double-ended socket wrench for sprinkler nozzles which includes a generally tubular housing having a socket wrench formed therein. The housing includes open first and second ends with an elongate chamber extending between the ends to allow water to enter in one end and pass out the opposing end of the housing. At least one of the open ends forms a socket wrench to nest with a sprinkler nozzle while water is passing through the nozzle (and housing) without significantly interfering with the flow of the water.

In accordance with one aspect of the present invention, a folding lever is attached to the housing. The lever is positioned so as to provide leverage to unscrew the nozzles and provide sufficient torque while replacing the nozzle.

In accordance with yet another aspect of the invention, each end of the housing includes a socket, each socket being a different size to allow use of the wrench with at least two different sizes of sprinkler nozzles.

BRIEF DESCRIPTION OF THE DRAWINGS

The above and other objects, features, and advantages of the invention will become apparent from a consideration of the following detailed description presented in conjunction with the accompanying drawings, in which.

DETAILED DESCRIPTION

Figure 1:
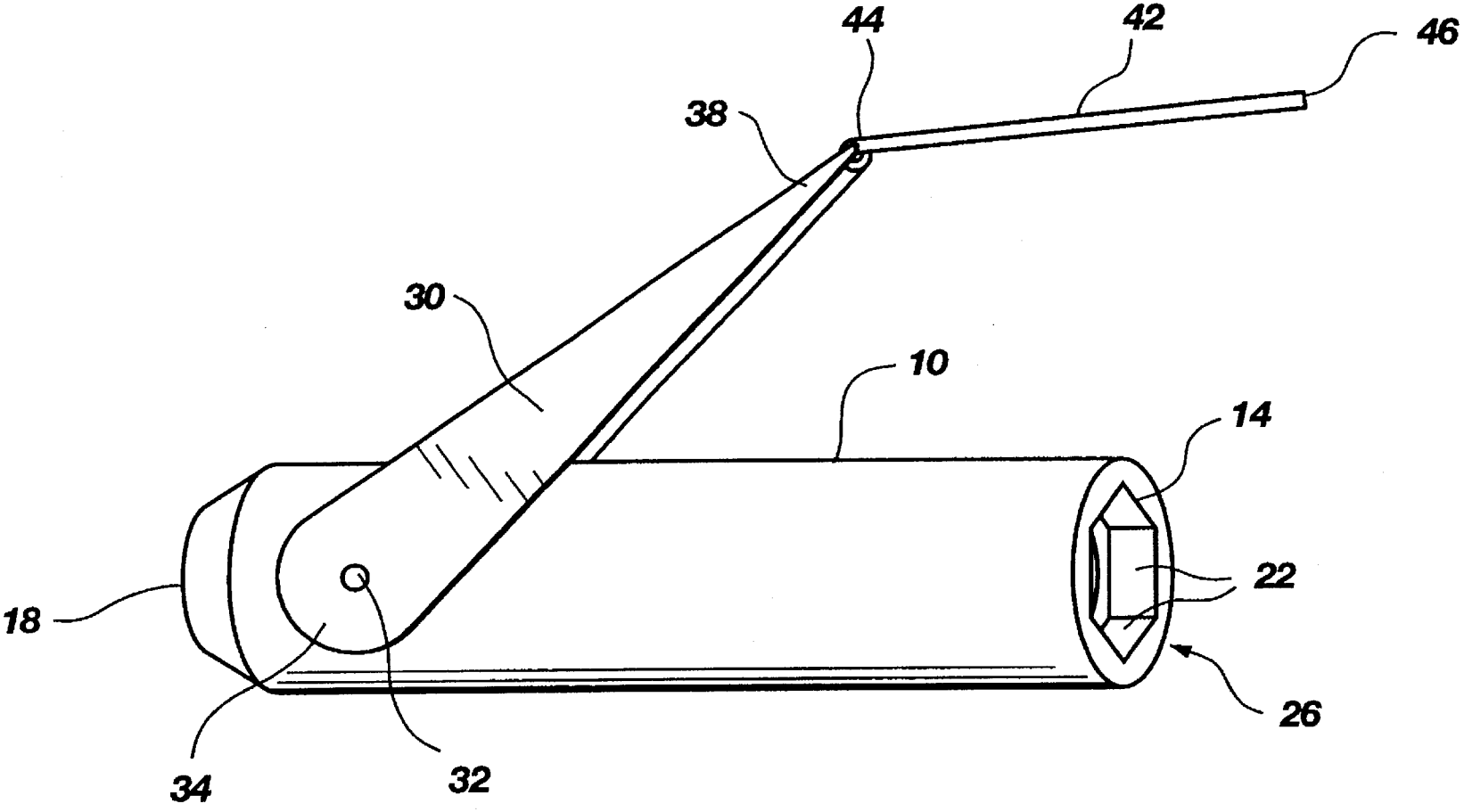
FIG. 1 shows a perspective view of the double-ended socket wrench with the lever and probe attached.

Reference will now be made to the drawings wherein the different structures comprising the present invention are given numeral designations. Referring to FIG. 1, there is shown a side perspective view of a double-sided socket wrench 2 which includes an elongate housing 10 and a lever 30 attached to the housing. The housing 10 has open first and second ends 14 and 18, respectively. At least one of the ends (in FIG. 1, end 14) has a plurality of surfaces 22. The surfaces extend in a direction generally perpendicular from the opening 14 to a position within the housing 10. The surfaces 22 are angled with respect to one another so as to form a socket 26 of a wrench capable of nesting about a nut or the outer surface of a sprinkler nozzle (not shown).

The housing 10 can be formed of virtually any durable, hard material. However, it is anticipated that the housing will be formed of a metal, such as steel or aluminum, or a hard plastic such as ABS. If metal is used, it is advisable to use a metal which is not prone to rusting. Otherwise, the metal will quickly deteriorate as it often will be in contact with water.

Figure 2:
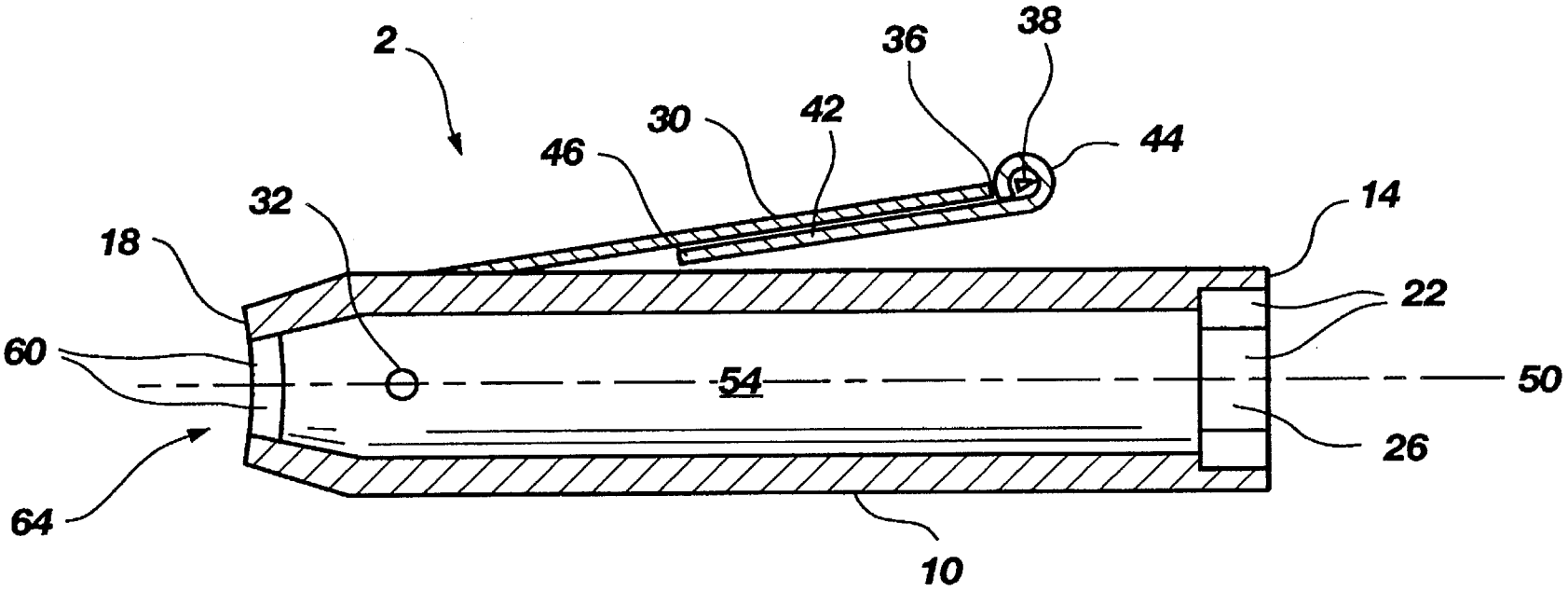
FIG. 2 shows a side cross-sectional view of the double-ended socket wrench shown in FIG. 1.

A lever 30 is attached to the housing 10 at a first, broad end 34. Preferably, the lever 30 is rotatably attached to the housing 10 by a pin 32. The pin 32 allows a second, narrower end 38 of the lever 30 to move between positions adjacent to the housing (shown in FIG. 2) and away from the housing (FIG. 1). When the lever 30 is rotated so that the second, narrow end 38 is positioned away from housing 10, the lever provides leverage for rotating the housing 10 about its longitudinal axis (FIG. 2). The leverage is important for removing firmly tightened sprinkler nozzles and for securing replacement nozzles so that they do not work their way loose from the sprinkler head.

Attached to the second, narrow end 38 of the lever 30 is a probe means 42 which is used to dislodge sediment and other blockages in the sprinkler nozzle or in the sprinkler head. The probe is attached at a first end 44 to the lever 30 in a manner which will be discussed in more detail with respect to FIG. 2. The opposing end 46 is inserted into the nozzle or, if the nozzle has been removed, into the sprinkler head to restore water flow. The probe 42 is usually made of steel or some other metal so that it will be sufficiently strong to break through the blockage.

The probe 42 is rotatable between a first, outward pointing position (shown in FIG. 1), in which it is used as described above, and a second, inward pointing position (shown in FIG. 2) in which it is positioned between the lever 30 and the housing 10. The second position (FIG. 2) prevents the probe 42 from accidentally stabbing the user when the double-ended socket wrench 2 is placed in a pocket or belt holder.

Referring now to FIG. 2, there is shown a side cross-sectional view of the double-ended socket wrench 2 exposing its longitudinal axis 50. While shown in FIGS. 1 and 2 as being generally cylindrical, the housing 10 could be numerous different shapes. For example, it may be simple to manufacture the housing so that it has a hexagonal cross-section similar to that of a socket 26. Regardless of its shape, the important aspect to the housing 10 is that it form a pathway 54 through which water may flow. Thus, as one end of the double-ended socket wrench 2 is nested about a sprinkler nozzle (not shown), the water exiting the nozzle flows through the housing 10 and passes out the other end.

As represented in FIG. 2, the first end 14 has a plurality of surfaces 22 which extend inwardly and are angled with respect to one another so as to form a socket 26. At the second end 18, there is shown a second plurality of surfaces 60, arranged similarly to surfaces 22, and forming a second socket 64. The primary difference between the first surfaces 22 and the second surfaces 60 is that the second surfaces are smaller, forming a smaller socket 64. Thus, the first and second ends 14 and 18 of the wrench 2 will nest with different size nuts or sprinkler nozzles (not shown).

In a preferred embodiment, it is anticipated that the socket 26 of the first end 14 will have a diameter of about ¾ of one inch while the socket 64 at the second end 18 will have a diameter of about ½ of an inch. These sizes are due, in large part, to the common sizes of sprinkler nozzles. Flow control nozzles, which deliver a constant amount of water at different pressures, typically have a nut section which is ¾ of an inch in diameter. Other sprinkler nozzles tend to be ½ inch. Thus, by having different first and second ends 14 and 18, a single double-ended wrench 2 can be used to connect and remove both common types of nozzles.

Above the housing 10 in FIG. 2 is the lever 30 and the probe 42. As was alluded to earlier, the probe 42 has a first end 44 which is curved through a hole 36 in the second, narrow end 38 of the lever 30. The probe 42 has been rotated from its outwardly extending position in FIG. 1 to a position in which the second end 46 is held between the lever 30 and the housing 10. When the probe 42 is in such a position, the double-ended wrench 2 can be placed in a pocket or belt loop with little risk that the probe might accidently stab the user.

Also shown in FIG. 2 is the pin 32 which extends through the housing 10. Having the pin pass all the way through the housing 10 gives the lever 30 better support and allows a significant amount of force to be applied to the lever. Additionally, the pin provides a stop so that a ½ inch nozzle placed in the second end 18 cannot slip (or be forced) through the pathway 54 and fall out the first end 14. The pin 32, however, is thin enough that it does not significantly interfere with water flow through the pathway. If for some reason a pin 32 would not be desirable, a similar result could be achieved by placing a projection into the pathway 54.

Figure 3:
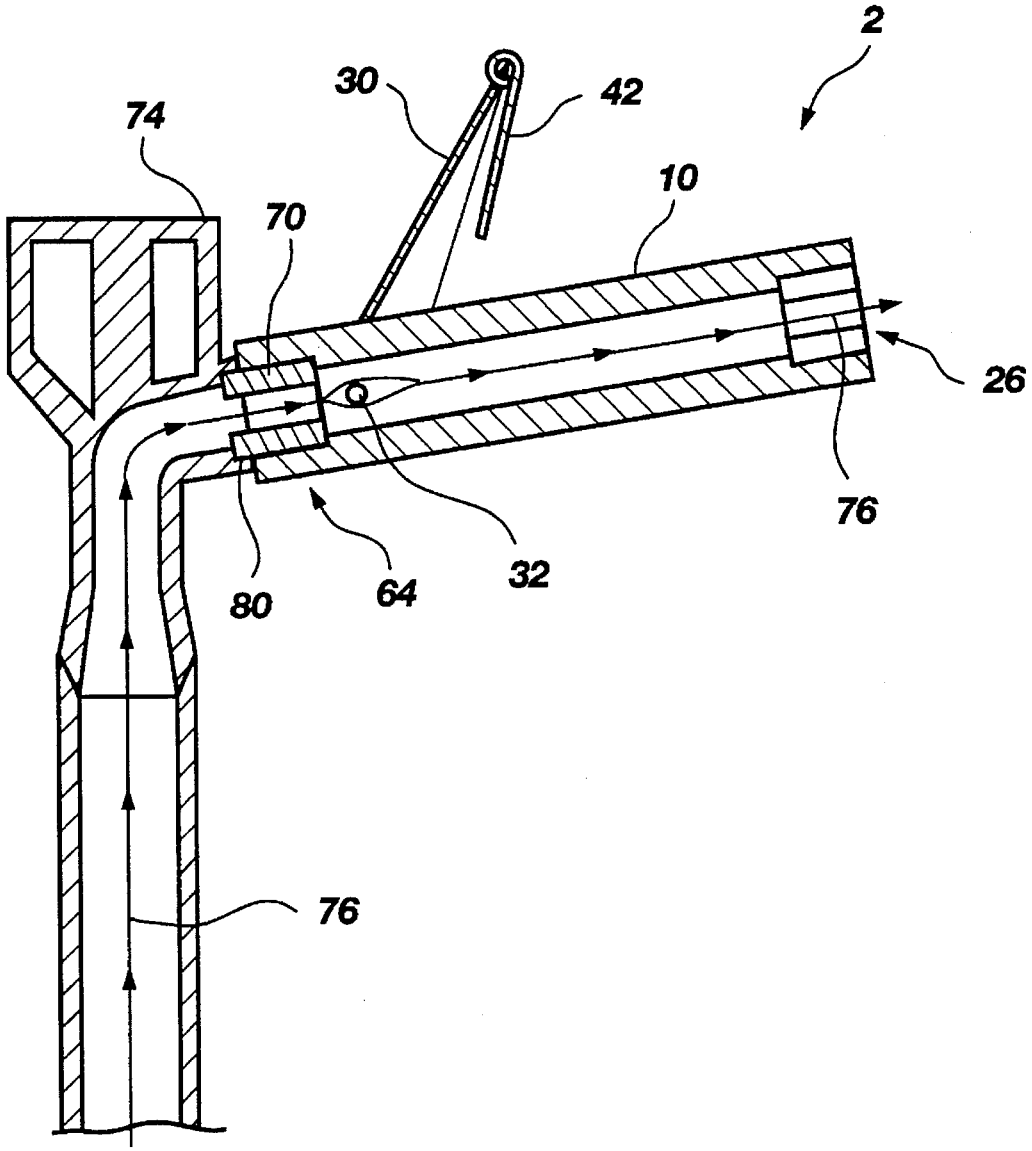
FIG. 3 shows a side cross-sectional view of a double ended socket wrench being mounted on a sprinkler nozzle while water is passing through the sprinkler.

Referring now to FIG. 3, there is shown a side cross-sectional view of a double-ended socket wrench 2 mounted on a sprinkler nozzle 70. The nozzle 70 is attached to a sprinkler head 74 through which water is running. The water follows the pathway indicated by the arrow 76.

The socket 64 is positioned so as to surround the nozzle 70. Depending on which way force is exerted on the lever 30, the socket 64 will tighten or loosen the nozzle 70. If the nozzle 70 is being loosened, the wrench 2 will hold the nozzle 70 rather than allow the nozzle to be carried with the water flowing through the wrench 2. This is primarily done by the pin 32 which causes a slight interference to water flow 76 through the wrench 2. The same effect is reached for socket 26 in that socket 64 is smaller, thereby preventing a sprinkler nozzle 70 in socket 26 from being carried out of the housing 10 by the water flow 76.

While not shown in FIG. 3, the depth of the socket 64 could be deep and slightly belled near the opening so as enable the socket to cover the joinder 80 of the nozzle 70 to the sprinkler head 74. Covering the joinder 80 would limit the amount of water spraying radially from between the nozzle 70 and sprinkler head 74 as the nozzle is being removed or replaced. This, in turn, would limit the amount of water being sprayed on the person removing the nozzle 70.

As is demonstrated in FIG. 3, the double-ended socket wrench 2 enables the nozzle 70 to be removed from the sprinkler head 74 with little interference to water flow 76. Had a conventional socket wrench been used, it would have been difficult to keep the socket in contact with the nozzle 70 because it would be pushed away by the pressurized water being forced through the nozzle. Additionally, the person using the socket wrench would likely become drenched as the socket directed the pressurized water back in his or her direction.

Figure 4:
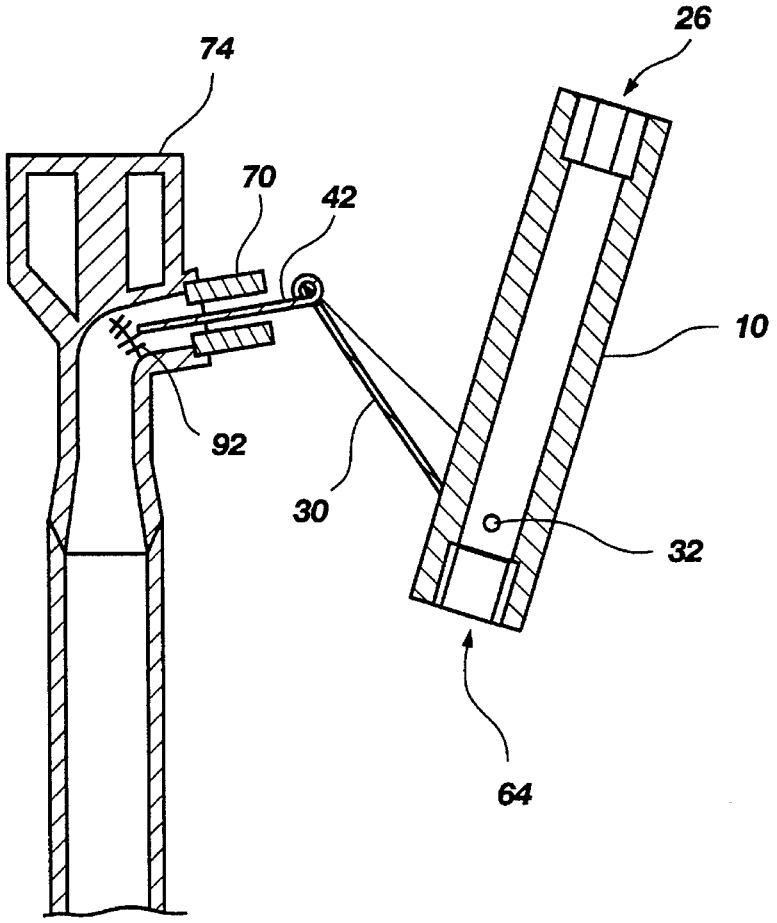
FIG. 4 shows a side cross-sectional view of the probe inserted in the nozzle to dislodge debris interfering with water flow thigh the sprinkler head.

Referring now to FIG. 4, there is shown a side cross-sectional view of the probe 42 being inserted through the nozzle 70 to break up a clog 92 formed by sediment. If the clog 92 were to be allowed to remain, water flow through the sprinkler head 74 would be limited and some of the crops serviced by the particular sprinkler head may not receive enough water. The probe 42 is a convenient tool and, when combined with the double-ended socket wrench 2, can easily be carried in a person's pocket, a belt loop, or in a tool box carried on farm machinery. Having the probe 42 attached to the double-ended wrench 2 decreases the risk that the probe will be lost. Such an attachment also makes the probe 42 safer as it can be placed between the lever 30 and the housing 10 as shown in FIG. 2.

Figure 5:
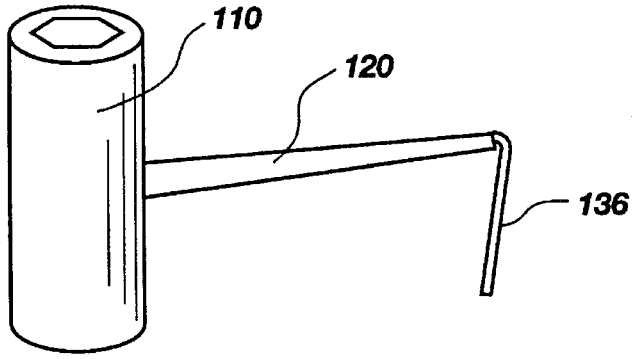
FIG. 5 shows an elevated perspective view of an alternate embodiment of the present invention.

Referring now to FIG. 5, there is shown an elevated perspective view of an alternate embodiment of the present invention. The housing 110 is functionally the same as housing 10 described above. However, in place of lever 30 (FIGS. 1–4), a handle 120 extends from the housing 110 and is rigidly affixed thereto. A probe 130 can be attached to the handle 120 in the manner shown or in some other convenient manner. The primary advantage of the embodiment of the invention shown in FIG. 5 is that the handle 120 and the housing 110 could be cast as a single piece of material. The handle 120 would be able to tolerate more pressure without coming apart from the housing 110. There also would be no need to have a pin extend through the housing 110. A small flange could be used to prevent a nozzle from passing through the housing 110. The single piece housing 110 and handle 120, however, would lack the compatibility of the preferred embodiment of the present invention and would not have the safety aspects described above.

In the manner described, an improved double-ended socket wrench is provided. The wrench utilizes an elongate housing which is open at each end so as to allow water to flow through the wrench. At least one end of the wrench forms a socket which nests with a sprinkler nozzle so that the nozzle may be removed while causing minimal disruption to water flow through the sprinkler head. It is to be understood that the above-described arrangements are only illustrative of the application of the principles of the present invention. Numerous modifications and alternative arrangements may be devised by those skilled in the art without departing from the spirit and scope of the present invention, and the appended claims are intended to cover such modifications and arrangements.

What is claimed is:

1. A wrench for removing nozzles from sprinkler heads and the like, the wrench comprising:

a housing comprising an exterior wall disposed so as to define an elongate void extending from a first open end of the housing to a second open end thereof, the first end including a plurality of surfaces formed in the wall and extending from the opening to a point within the housing so as to define a socket in the first end, the socket being nestable with an angled outer surface of a sprinkler nozzle, leverage means connected to the housing to facilitate rotation of the housing about the longitudinal axis thereof, and probe means connected to the housing, the probe means being of sufficient length and width to enter a nozzle and dislodge debris in a sprinkler head.

2. The double-ended socket wrench of claim 1, further comprising a second socket formed in the second end of the housing, the socket having a plurality of surfaces angled with respect to each other and disposed about an inner side of the exterior wall at the second end.

3. The double-ended socket wrench of claim 2 wherein the socket of the first end comprises a first, larger diameter and the socket of the second end comprises a second, smaller diameter.

4. The double-ended socket wrench of claim 1 wherein the leverage means comprises a lever attached to the housing and extending transversely therefrom such that rotation of the lever means about a longitudinal axis of the housing causes a corresponding rotation of the housing.

5. The double-ended socket wrench of claim 4 further comprising adjustable means for attaching the lever to the housing such that the lever is rotatable between a position adjacent to the housing and generally parallel therewith, and a position generally perpendicular to the housing.

6. The double-ended socket wrench of claim 5 wherein the probe is rotatably attached to the lever.

7. The double-ended socket wrench of claim 6 wherein the probe is rotatively attached to the lever means, the probe being rotatable between a position generally parallel to the lever means and a position generally perpendicular to the lever means.

8. A wrench for removing nozzles from sprinkler heads and the like, the wrench comprising elongate housing means forming an elongate void, the housing means comprising a first end having an opening in communication with the void and a plurality of surfaces extending adjacent the void from the opening of the first end to a point within the housing, the surfaces being angled with respect to one another so as to define a first socket in the first end;

a second end having an opening in communication with the void and a plurality of surfaces extending adjacent the void from the opening in the second end to a point within the housing, the second plurality of surfaces being angled with respect to one another so as to define a second socket in the second end, lever means attached to the elongate housing means and extending transversely from the elongate housing means to provide leverage for rotating the housing means; and a probe means attached to the lever means for dislodging debris in a sprinkler head.

* * * * *